US008648761B2

(12) United States Patent
Ishibana et al.

(10) Patent No.: US 8,648,761 B2
(45) Date of Patent: Feb. 11, 2014

(54) BEHIND-THE-EAR WIRELESS DEVICE

(75) Inventors: Kyouko Ishibana, Tokyo (JP); Naoki Matsubara, Tokyo (JP); Tomoaki Nishikido, Ishikawa (JP); Yoshio Koyanagi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 799 days.

(21) Appl. No.: 12/866,114

(22) PCT Filed: Feb. 2, 2009

(86) PCT No.: PCT/JP2009/000392

§ 371 (c)(1),
(2), (4) Date: Sep. 8, 2010

(87) PCT Pub. No.: WO2009/098858

PCT Pub. Date: Aug. 13, 2009

(65) Prior Publication Data

US 2010/0321269 A1 Dec. 23, 2010

(30) Foreign Application Priority Data

Feb. 4, 2008 (JP) ..... P2008-023607

(51) Int. Cl.
*H01Q 19/26* (2006.01)
*H04R 25/00* (2006.01)
*H01Q 19/10* (2006.01)

(52) U.S. Cl.
USPC ..... 343/834; 343/833; 381/381

(58) Field of Classification Search
USPC ..... 343/833, 834; 381/23.1, 381; 455/575.2
See application file for complete search history.

(56) References Cited

U.S. PATENT DOCUMENTS

| | | | | |
|---|---|---|---|---|
| 6,396,935 | B1 * | 5/2002 | Makkonen | 381/334 |
| 6,549,633 | B1 | 4/2003 | Westermann | |
| 7,409,064 | B2 | 8/2008 | Watanuki | |
| 7,528,783 | B2 * | 5/2009 | Takagi | 343/702 |
| 7,535,364 | B2 | 5/2009 | Sakama et al. | |
| 7,570,777 | B1 * | 8/2009 | Taenzer et al. | 381/381 |
| 2002/0039424 | A1 | 4/2002 | Watanuki | |
| 2005/0244024 | A1 * | 11/2005 | Fischer et al. | 381/331 |
| 2007/0046465 | A1 | 3/2007 | Sakama et al. | |
| 2007/0162169 | A1 | 7/2007 | Watanuki | |
| 2008/0304686 | A1 * | 12/2008 | Meskens et al. | 381/330 |
| 2009/0231204 | A1 * | 9/2009 | Shaker et al. | 343/700 MS |

FOREIGN PATENT DOCUMENTS

| | | |
|---|---|---|
| JP | 64-034100 | 2/1989 |
| JP | 2000-083297 | 3/2000 |
| JP | 3078858 | 4/2001 |
| JP | 2002-504794 | 2/2002 |

(Continued)

OTHER PUBLICATIONS

International Search Report of PCT Application No. PCT/JP2009/000392 dated May 12, 2009.

*Primary Examiner* — Jacob Y Choi
*Assistant Examiner* — Amal Patel
(74) *Attorney, Agent, or Firm* — Panasonic Patent Center

(57) ABSTRACT

A behind-the-ear wireless device includes a main body casing including a wireless circuit housed therein and an audio transmission unit having a function of transmitting sound to an ear. The main body casing and the audio transmission unit are integrally connected to each other, whereby the wireless device can be fitted to the ear. An antenna element having a length of about half wave length is disposed in a hollow of the sound tube. A parasitic element having a length of about a half wave length is disposed in the main body casing.

9 Claims, 4 Drawing Sheets

(56) References Cited

FOREIGN PATENT DOCUMENTS

| | | |
|---|---|---|
| JP | 2002-112383 | 4/2002 |
| JP | 2004-361910 | 12/2004 |
| JP | 2005-304038 | 10/2005 |
| JP | 2006-338957 | 12/2006 |
| JP | 2007-060386 | 3/2007 |

* cited by examiner

BEHIND-THE-EAR WIRELESS DEVICE

CROSS-REFERENCE TO RELATED APPLICATIONS

This application is a National Stage of International Application No. PCT/JP2009/000392, filed Feb. 2, 2009 and claims priority under 35 U.S.C. §119(a) to Japanese Patent Application No. 2008-023607, filed in Japan on Feb. 4, 2008 the entire contents of which are hereby incorporated herein by reference.

TECHNICAL FIELD

The present invention relates to a behind-the-ear wireless device used while fitted behind the ear, and more particularly to an antenna employed in a behind-the-ear hearing aid having a function of establishing communication with a video display device, such as a TV.

BACKGROUND ART

In a field to hearing aids, a number of hearing aids with wireless communication functions are proposed, such as a function of establishing communication with a device that controls a sound volume of the hearing aid (e.g., Patent Document 1) and a function of performing signal processing to sound by establishing communication between right and left hearing aids in order to help a user to recognize a direction of a sound source (e.g., Patent Document 2).

A technique in relation to an antenna incorporated in a hearing aid is proposed as described, e.g., in Patent Document 3, in which an L-shaped or a coil-shaped antenna is formed by a conductive film in a hearing aid housing to be fit behind the ear, whereby a space for the antenna on a substrate can be dispensed with.

As an antenna of a wireless device used while fitted to the ear other than the hearing aid, a configuration of an antenna for an FM radio wave which is mounted to a behind-the-ear transceiver as is described, e.g., in Patent Document 4. In the antenna, a transceiver is held by an ear using a soft, slightly-flexible ear holding member. An antenna is arranged to protrude from a casing so as to extend from the ear toward the zenith. A microphone protrudes from the casing so as to be situated near a mouth. A printed board having an electronic circuit for wireless transceiving operation, a speaker oriented an ear face, a battery, etc. are disposed in the casing.

According to the configuration, the transceiver is used as a handset of a telephone set not shown. The transceiver receives an FM radio wave transmitted from the telephone set (a main phone) by the antenna and reproduces an audio signal, and the audio signal is output from the speaker near the ear. Speech sound picked up by the microphone can be converted into an FM radio wave, and the radio wave can be transmitted from the antenna to the telephone set (the main phone).

As a built-in antenna of a wireless device used while fitted behind the ear, a configuration of a behind-the-ear cordless earphone is described, e.g., in Patent Document 5. In the behind-the-ear cordless earphone, an ear hanger used for fitting a behind-the-ear cordless earphone to an ear is joined to the casing by way of a shaft and a joint. In a state where the behind-the-ear cordless earphone is fitted to the ear, a speaker becomes situated near the ear, and the microphone becomes situated near the mouth. An interior of the ear hanger is formed from a flexible metallic material, and an exterior of the ear hanger is coated with one layer of elastic substance.

The metallic material in the ear hanger is used as a receiving antenna. According to the configuration, the antenna is built inside.

Incidentally, users of hearing aids have a desire to clearly hear sounds while watching a TV, etc. The desire can be fulfilled by establishing wireless communication between a TV set and the hearing aid and receiving a sound signal of the TV by the hearing aid. The TV set lies in a line of sight of the user of the hearing aid when the user watches a TV program. For this reason, the directivity of the antenna mounted to the hearing aid is desired to be oriented toward the line of sight when the user is wearing the hearing aid.

Patent Document 1: JP-A-2000-83297
Patent Document 2: JP-A-2002-504794
Patent Document 3: JP-A-2005-304038
Patent Document 4: JP-A-2004-361910 (FIG. 8)
Patent Document 5: JP-U-3078858 (FIG. 3)

DISCLOSURE OF THE INVENTION

Problem to be Solved by the Invention

However, the related art configurations described in Patent Documents 1 and 2 do not disclose detailed configurations of the antennas, and are not intended for communication between the hearing aid and a device existing in the line of sight. Therefore, directivity of the antenna is not oriented in the direction of the line of sight.

In the related art configurations described in Patent Documents 3 and 5, when a hearing aid or an earphone is worn, the antenna becomes proximal to a human head. Therefore, directivity of the antenna is not oriented in the direction of the line of sight.

In the related art configuration described in Patent Document 4, since the antenna protrudes, the problems is that the antenna is dangerous, usability is low, and design aesthetics is poor.

In order to solve the problems, the present invention provides a behind-the-ear wireless device in which directivity of an antenna is oriented in a direction of a user's line of sight by providing an antenna element and a parasitic element in a behind-the-ear device, such as a hearing aid and an earphone, and letting the parasitic element operate as a reflector.

Means for Solving the Problem

In order to solve the problems, a behind-the-ear wireless device of the present invention comprises a first main body casing including a wireless circuit housed therein and an audio transmission unit having a function of transmitting sound from the first main body casing to an earhole and can be fitted to an ear by a configuration in which the first main body casing and the audio transmission unit are integrally connected, wherein the device comprises an antenna element having a length of about half wave length and disposed in the audio transmission unit, and a parasitic element having a length of about half wave length or more and disposed in the first main body casing.

According to the configuration, the parasitic element operates as a reflector, and directivity of the antenna can be oriented in a direction of a user's line of sight in a state where the behind-the-ear wireless device is fitted to the ear. Consequently, it is possible to enhance performance of communication with a TV set, or the like, positioned on the line of sight.

A behind-the-ear wireless device of the present invention comprises a first main body casing including a wireless circuit housed therein and an audio transmission unit having a function of transmitting sound from the first main body casing to an earhole and can be fitted to an ear by a configuration in which the first main body casing and the audio transmission unit are integrally connected, wherein the antenna element is disposed in the first main body casing, the parasitic element is disposed in the audio transmission unit, and a length of the parasitic element is less than about half wave length.

According to the configuration, the parasitic element operates as a wave director, and an advantage similar to that mentioned above is also yielded.

A behind-the-ear wireless device of the present invention comprises a second main body casing including the wireless circuit and a speaker housed therein and a behind-the-ear hanger, and is configured such that, in a state where the behind-the-ear hanger is fitted to the ear, the second main body casing contacts a surface of an ear capsule in which an earhole exists, whereby sound is transmitted from the speaker to the ear, wherein the antenna element having a length about half wave length is disposed in the second main body casing, and the parasitic element having a length of about half wave length or more is disposed in the behind-the-ear hanger.

According to the configuration, the parasitic element operates as a reflector, and an advantage similar to that mentioned above is yielded.

A behind-the-ear wireless device of the present invention includes a second main body casing including the wireless circuit and a speaker housed therein and a behind-the-ear hanger, and is configured such that, in a state where the behind-the-ear hanger is fitted to the ear, the second main body casing contacts a surface of an ear capsule in which an earhole exists, whereby sound is transmitted from the speaker to the ear, wherein the antenna element is disposed in the behind-the-ear hanger; the parasitic element is disposed in the second main body casing; and the length of the parasitic element is less than about half wave length.

According to the configuration, the parasitic element operates as a wave director, and an advantage similar to that mentioned above is yielded.

The behind-the-ear wireless device of the present invention comprises an earphone capable of being fitted into the earhole and having a function as an audio output device, and an earphone cable provided in the audio transmission unit and having a function of transmitting an audio signal from the first main body casing to the earphone, wherein the earphone cable serves as the antenna element.

According to the configuration, it is not necessary to additionally provide a component dedicated for the antenna element, so that the number of components and cost can be reduced.

The behind-the-ear wireless device of the present invention comprises an earphone capable of being fitted into the earhole and having a function as an audio output device, and an earphone cable provided in the audio transmission unit and having a function of transmitting an audio signal from the first main body casing to the earphone, wherein the earphone cable serves as the parasitic element.

According to the configuration, it is not necessary to additionally provide a component dedicated for a parasitic element, so that an advantage similar to that described previously is yielded.

Advantages of the Invention

As mentioned above, according to the present invention, in the behind-the-ear wireless device, the antenna element having a length of about half wave length is disposed in the audio transmission unit, and the parasitic element having a length of about half the wave length or more is disposed in the main body casing. The parasitic element thereby operates as a reflector. The directivity of the antenna can be oriented in the direction of the user's line of sight in a state where the behind-the-ear wireless device is fitted to the ear, so that performance of communication with a TV set, or the like, positioned on the line of sight is enhanced.

DESCRIPTION OF REFERENCE SIGNS

1 EAR
2 LINE OF SIGHT
100 BEHIND-THE-EAR WIRELESS DEVICE
101 MAIN BODY CASING (A)
102 SOUND TUBE
103 EARHOLE UNIT
104 ANTENNA ELEMENT
105 WIRELESS CIRCUIT
106 AUDIO SIGNAL PROCESSING UNIT
107 PARASITIC ELEMENT (REFLECTOR)
108 SPEAKER
309 PARASITIC ELEMENT (WAVE DIRECTOR)
410 MAIN BODY CASING (B)
411 BEHIND-THE-YEAR HANGER
412 EARPHONE PAD
713 EARPHONE
714 EARPHONE CABLE
715 GROUNDED OUTER CONDUCTOR
716 AUDIO SIGNAL LINE
717 COIL
718 MATCHING CIRCUIT

BEST MODE FOR CARRYING OUT THE INVENTION

Embodiments of the present invention are hereunder described by reference to the drawings.

First Embodiment

Figure 1:
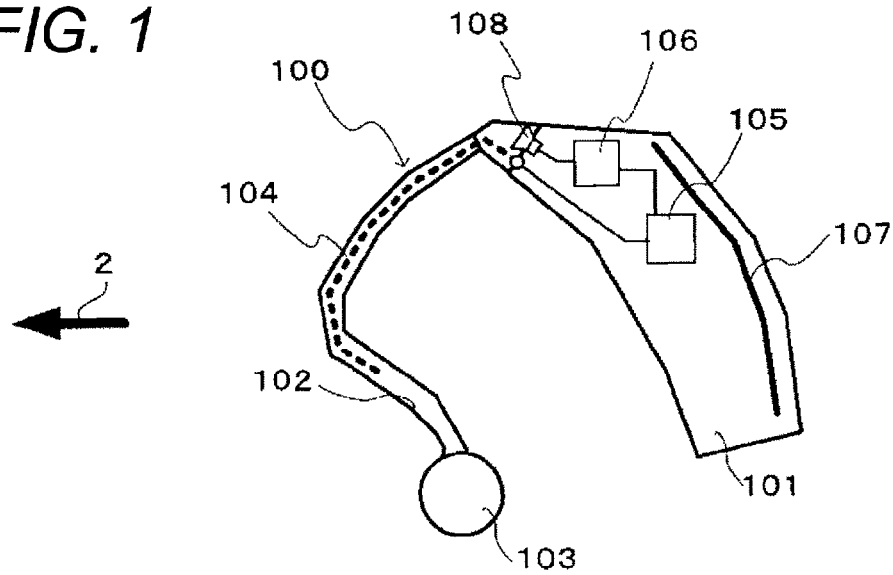
FIG. 1 is a schematic diagram of an antenna of a behind-the-ear wireless device of a first embodiment of the present invention.
Figure 2:
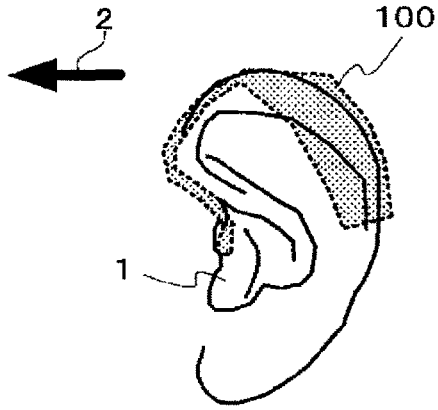
FIG. 2 is a view of a state of usage of the behind-the-ear wireless device of the first embodiment of the present invention.

FIG. 1 shows a schematic diagram of an antenna of a behind-the-ear wireless device of a first embodiment of the present invention, and FIG. 2 shows a view of a state of usage of the behind-the-ear wireless device of the first embodiment of the present invention. Descriptions are provided on condition that an operating frequency is set, for example, to 2.4 GHz.

As shown in FIG. 2, a behind-the-ear wireless device 100 is fitted to an ear 1. An antenna of the behind-the-ear wireless device 100 is configured as described below, whereby directivity of the antenna is oriented in a direction of a line of sight 2.

In FIG. 1, a shape and dimension of the behind-the-ear wireless device 100 is defined so as to allow the behind-the-ear wireless device 100 to be fitted to the ear 1, by a configuration in which the main body casing (A) 101 is integrally connected to one end of a sound tube 102. An earhole unit 103 is located at the other end of the sound tube 102. In a state where the behind-the-ear wireless device 100 is fitted to the ear 1, the earhole unit 103 is stored in the earhole. The sound tube 102 is hollow, and an antenna element 104 is positioned in a hollow of the sound tube 102. The antenna element 104 has a length of about a half wave length, for example, about 62 mm. One end of the antenna element 104 is connected to an audio signal processing unit 106 via a wireless circuit 105 disposed in the main body casing (A) 101. A parasitic element (a reflector) 107 is disposed in the main body casing (A) 101 such that a distance from the parasitic element 107 to the antenna 104 becomes about a quarter of the wave length, for example, about 31 mm. The parasitic element has a length of a half wave length or more, for example, about 63 mm. The audio signal processing unit 106 is disposed in the main body casing (A) 101, processes an audio signal demodulated by the wireless circuit 105, and outputs a resultant signal to a speaker 108. The speaker 108 is placed at a portion of the main body casing (A) 101 where the main body casing (A) 101 is connected to the sound tube 102, converts an audio signal output from the audio signal processing unit 106 into sound, and outputs the resultant sound to the sound tube 102. The sound tube 102 transmits the sound output from the speaker 108 through the hollow thereof, to the ear 1 via the earhole unit 103.

Operation of the antenna of the behind-the-ear wireless device 100 configured as mentioned above is now described. As mentioned above, the length of the antenna element 104 is about a half wave length. The length of the parasitic element (the reflector) 107 has a length of a half wave length or more. The distance between the antenna element 104 and the parasitic element (the reflector) 107 is about a quarter of the wave length. Therefore, the parasitic element (the reflector) 107 operates as a reflector, and the directivity of the antenna can be oriented in the direction of the user's line of sight 2.

As mentioned above, according to the first embodiment, the antenna element 104 having a length of about half wave length is disposed in the hollow of the sound tube 102, and the parasitic element (the reflector) 107 having a length of half wave length or more is disposed in the main body casing (A) 101, such that a distance between the antenna element 104 and the parasitic element 107 becomes about a quarter of a wave length. According to the configuration, the parasitic element (reflector) 107 operates as a reflector, and the directivity of the antenna can be oriented in the direction of the user's line of sight 2. Performance of communication with a TV set, or the like, situated on the line of sight can be enhanced.

The size of the behind-the-ear wireless device 100 is desired to be reduced in order to prevent the other people from recognizing the wearing of the device and to lessen a burden imposed while the user is wearing the device. When the parasitic element (the reflector) 107 has a meandering shape, the volume of the wireless device can be reduced while the length of the parasitic element 107 is assured, and also antenna performance similar to that achieved when the parasitic element (the reflector) 107 of other than a meandering shape can be achieved.

Similar antenna performance can be achieved even when a conductor piece as the parasitic element (reflector) 107 is placed an outer surface of the main body casing (A) 101.

Even when the parasitic element (the reflector) 107 is a conductive paint coating having a predetermined shape, similar antenna performance is achieved.

Second Embodiment

Figure 3:
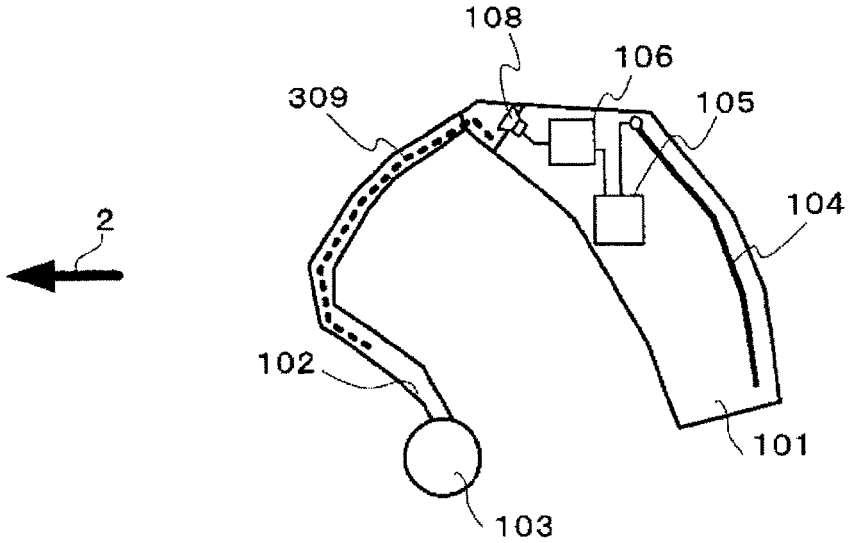
FIG. 3 is a schematic diagram of an antenna of a behind-the-ear wireless device of a second embodiment of the present invention.

FIG. 3 is a schematic diagram of an antenna of a behind-the-ear wireless device of a second embodiment of the present invention. Elements identical with those shown in FIGS. 1 and 2 are assigned the same reference numerals, and their repeated explanations are omitted.

In FIG. 3, a parasitic element (a wave director) 309 is disposed in the hollow of the sound tube 102. The parasitic element (the wave director) 309 has a length of less than a half wave length, for example, about 61 mm. The antenna element 104 is disposed inside of the main body casing (A) 101 such that the distance between the antenna element 104 and the parasitic element (the wave director) 309 becames about a quarter of the wave length, for example, about 31 mm. One end of the antenna element 104 is connected to the audio signal processing unit 106 via the wireless circuit 105.

Operation of an antenna of the thus-configured behind-the-ear wireless device 100 is now described. The length of the antenna element 104 is about half wave length, and the length of the parasitic element (the wave director) 309 is less than a half wave length. The distance between the antenna element 104 and the parasitic element (the wave director) 309 is about a quarter of the wave length. Consequently, the parasitic element (the wave director) 309 operates as a wave director, and the directivity of the antenna can be oriented in the direction of the user's line of sight 2.

As mentioned above, according to the second embodiment, the parasitic element (the wave director) 309 having a length of less than half wave length is disposed in the hollow of the sound tube 102, and the antenna element 104 having about half wave length is disposed inside of the main body casing (A) 101, such that the distance between the antenna element 104 and the parasitic element (the wave director) 309 becomes about a quarter of the wave length. As a result, the parasitic element (the wave director) 309 operates as a wave director, and the directivity of the antenna can be oriented in the direction of the user's line of sight 2, so that performance of communication with a TV set, or the like, disposed on the line of sight is enhanced.

The antenna element 104 may have a meandering shape, and there is also yielded an advantage similar to that yielded when the parasitic element (the reflector) 107 has a meandering shape in the first embodiment.

Third Embodiment

Figure 4:
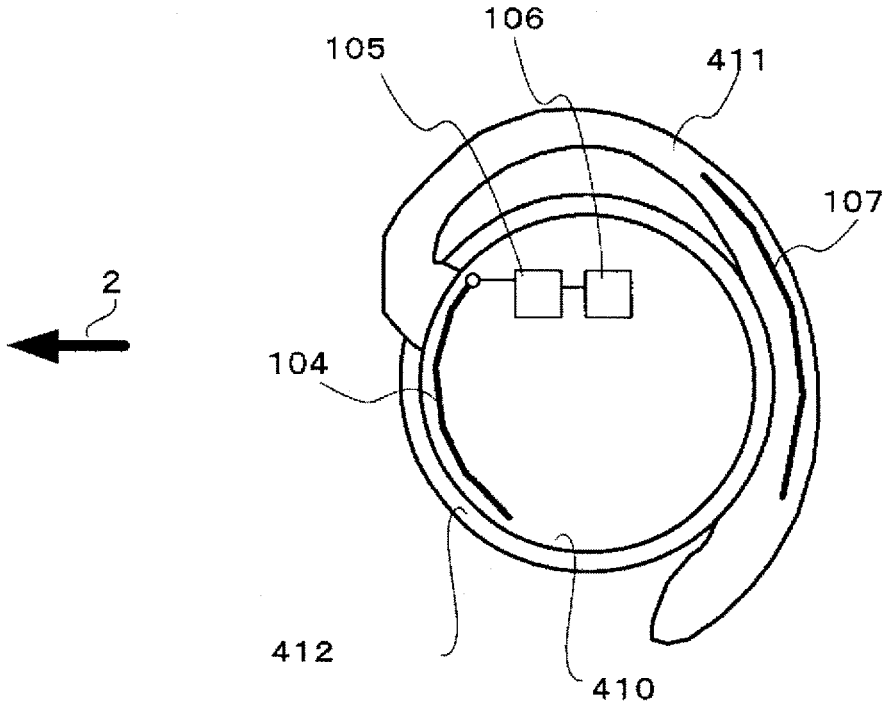
FIG. 4 is a schematic diagram of an antenna of a behind-the-ear wireless device of a third embodiment of the present invention.
Figure 5:
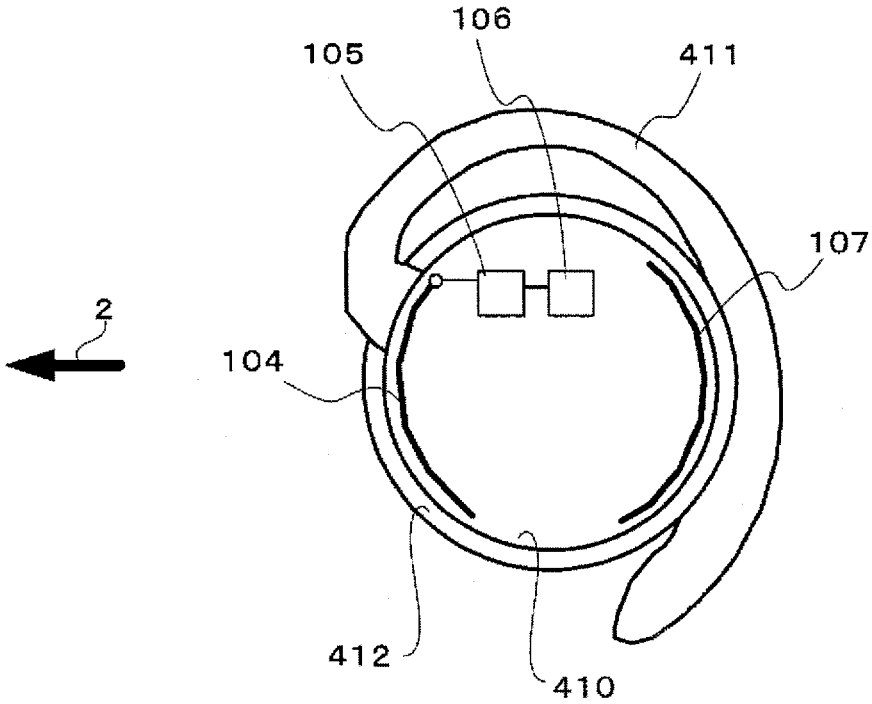
FIG. 5 is a schematic diagram of the antenna of the behind-the-ear wireless device of the third embodiment of the present invention.

FIGS. 4 and 5 are schematic diagrams of an antenna of a behind-the-ear wireless device of a third embodiment of the present invention. Constituent elements that are identical with their counterparts shown in FIGS. 1 and 2 are assigned the same reference numerals, and their repeated explanations are omitted.

In FIG. 4, in the behind-the-ear wireless device 100, a main body casing (B) 410 is connected to one end of a behind-the-ear hanger 411. The shape and dimension of the behind-the-ear wireless device 100 are defined such that a main body casing (B) 410 can contact a surface of an ear capsule when the behind-the-ear hanger 411 is hanged on the ear. An earphone pad 412 has a function of operating as a cushion between the main body casing (B) 410 and the ear 1 when the behind-the-ear wireless device 100 is fitted to the ear 1. The parasitic element (the reflector) 107 is disposed inside the behind-the-ear hanger 411. The antenna element 104 is disposed inside the main body casing (B) 410 such that a distance between the antenna element 104 and the parasitic element (the reflector) 107 becomes about a quarter of the wave length, for example, about 31 mm. The audio signal processing unit 106 outputs a processed audio signal to a speaker not shown. The speaker is disposed at a portion of the main body casing (B) 410 where the main body casing (B) 410 is connected to the earphone pad 412. Sound output from the speaker is transmitted to the ear 1 via the earphone pad 412.

In relation to the operation of the antenna of the behind-the-ear wireless device 100, the parasitic element (the reflector) 107 operates as a reflector, and the directivity of the antenna can be oriented in the direction of the user's line of sight 2, in the same manner as described in the first embodiment.

As mentioned above, according to the third embodiment, the parasitic element (the reflector) 107 having a length of half wave length or more is disposed inside of the behind-the-year hanger 411. Further, the antenna element 104 having about half wave length is disposed inside the main body casing (B) 410 such that the distance between the antenna element 104 and the parasitic element (the reflector) 107 becomes about a quarter of the wave length. Consequently, the parasitic element (the reflector) 107 can operate as a reflector, and the directivity of the antenna can be oriented in the direction of the user's line of sight 2, so that performance of communication with a TV set, or the like, placed on the line of sight can be enhanced.

As shown in FIG. 5, so long as the distance between the parasitic element (the reflector) 107 and the antenna element 104 can be secured up to about a quarter of the wave length in the main body casing (B) 410, the parasitic element (the reflector) 107 may be disposed in the main body casing (B) 410 rather than inside the behind-the-ear hanger 411. The configuration makes it possible to separate the parasitic element (the reflector) 107 away from a human head when the behind-the-ear wireless device 100 is fitted to the ear 1. Therefore, influence (deterioration of efficiency, influence of directivity, and the like) on the performance of the antenna inflicted by a human body can be lessened.

The antenna element 104 and the parasitic element (the reflector) 107 may have a meandering shape as described in the first and second embodiments.

Fourth Embodiment

Figure 6:
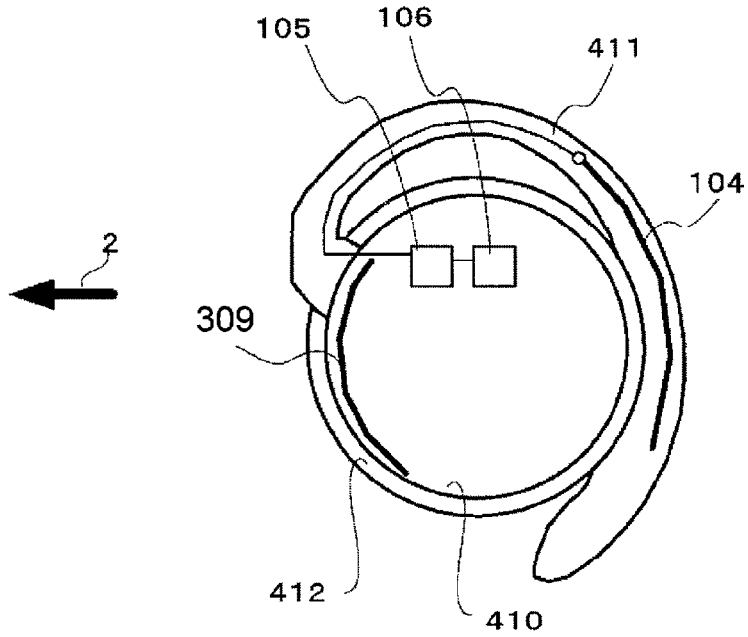
FIG. 6 is a schematic diagram of an antenna of a behind-the-ear wireless device of a fourth embodiment of the present invention.

FIG. 6 is a schematic diagram of an antenna of a behind-the-ear wireless device of a fourth embodiment of the present invention. Elements identical with those shown in FIGS. 1, 2, 3, and 4 are assigned the same reference numerals, and their repeated explanations are omitted.

In FIG. 6, the antenna element 104 is disposed inside the behind-the-ear hanger 411. The parasitic element (a wave director) 309 is disposed inside the main body casing (B) 410 such that the distance between the parasitic element 309 and the antenna element 104 becomes about a quarter of the wave length, for example, about 31 mm.

In the operation of the antenna of the behind-the-ear wireless device 100 configured as mentioned above, the parasitic element (the wave director) 309 operates as a wave director in the same manner as described in the second embodiment, so that the directivity of the antenna can be oriented in the direction of the user's line of sight.

According to the fourth embodiment, the antenna element 104 having a length of about half wave length is disposed inside of the behind-the-year hanger 411, and the parasitic element (the wave director) 309 having a length of less than a half wave length is disposed in the main body casing (B) 410, such that the distance between the parasitic element 309 and the antenna element 104 becomes about a quarter of the wave length. Consequently, the parasitic element (the wave director) 309 operates as a wave director, and the directivity of the antenna can be oriented in the direction of the user's line of sight 2, so that the performance of communication with a TV set, or the like, disposed on the line of sight can be enhanced.

Although not shown, so long as the distance between the parasitic element (the wave director) 309 and the antenna element 104 can be assured up to about a quarter of the wave length in the main body casing (B) 410, in the same manner as described in the third embodiment, the antenna element 104 can also be disposed in the main body casing (B) 410 rather than inside the behind-the-ear hanger 411. According to the configuration, the antenna element 104 can be separated away from the human head when the behind-the-ear wireless device 100 is fitted to the ear 1. Therefore, the influence on the performance (the efficiency and the directivity) of the antenna inflicted by the human body can be lessened.

The antenna element 104 and the parasitic element (the wave director) 309 may have a meandering shape as described in the first, second, and third embodiments.

Fifth Embodiment

Figure 7:
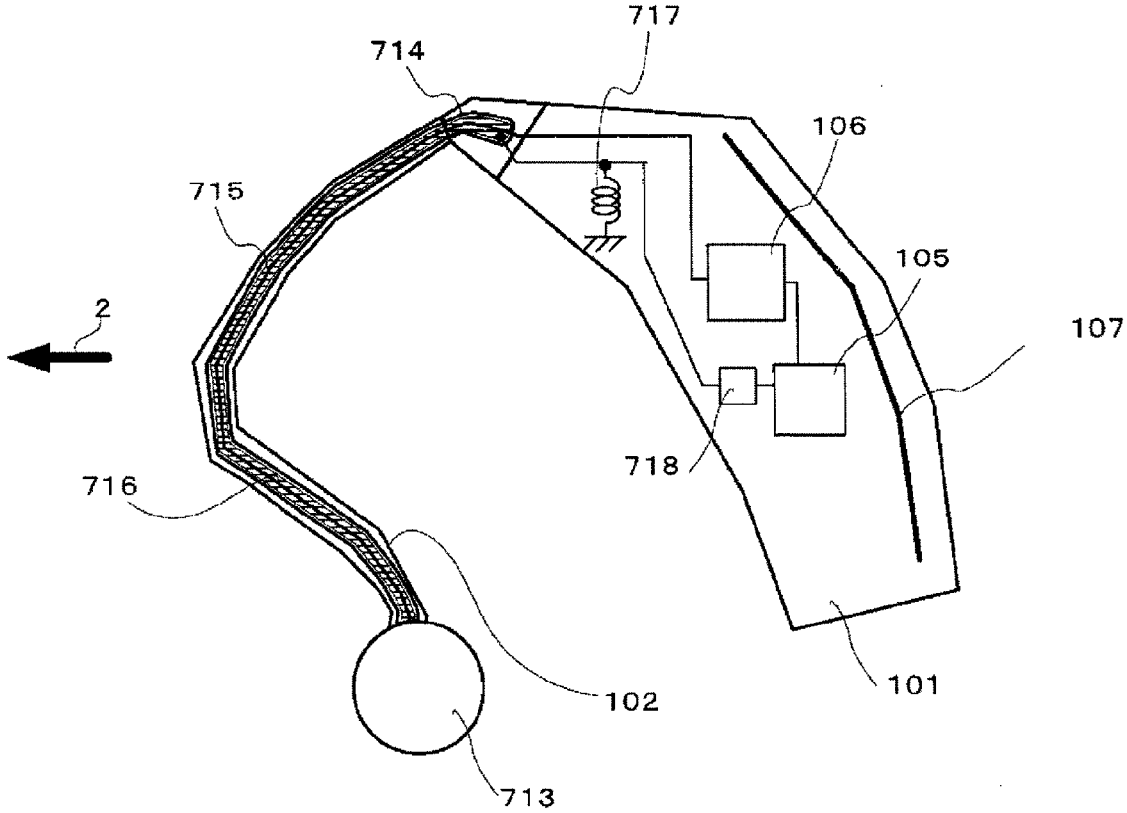
FIG. 7 is a schematic diagram of an antenna serving as both an earphone cable and an antenna of a behind-the-ear wireless device of a fifth embodiment of the present invention.

FIG. 7 shows a schematic diagram of an antenna serving as both an earphone cable and an antenna of a behind-the-ear wireless device of a fifth embodiment of the present invention. Elements identical with those shown in FIGS. 1 and 2 are assigned the same reference numerals, and their repeated explanations are omitted.

In FIG. 7, an earphone 713 converts an audio signal into sound and outputs the sound. The earphone 713 is put in a user's earhole when the behind-the-ear wireless device 100 is fitted to the ear 1. An earphone cable 714 is placed in the hollow of the sound tube 102. A grounded outer conductor 715 is of, for example, a meshed conducting wire, and covers and shields an audio signal line 716 in the earphone cable 714. One end of the grounded outer conductor 715 and one end of the audio signal line 716 are connected to the ear phone 713 in the earphone cable 714.

The other end of the audio signal line 716, which is not connected to the earphone 713, is connected to the audio signal processing unit 106 and transmits the audio signal output from the audio signal processing unit 106 to the earphone 713 in conjunction with the grounded outer conductor 715.

The grounded outer conductor 715 has a length of about half wave length, for example, about 62 mm. The other end of the grounded outer conductor 715, which is not connected to the earphone 713, is connected to a ground in the main body casing (A) 101 via a coil 717, i.e., a ground potential. The audio signal is thereby shielded by the grounded outer conductor 715 at a low frequency band that is an audio signal band. Further, the grounded outer conductor 715 is also connected to the audio signal processing unit 106 via a matching circuit 718. The matching circuit 718 has a function of effecting impedance matching between the grounded outer conductor 715 and the wireless circuit 105. According to a configuration, the grounded outer conductor 715 operates as an antenna. The parasitic element (the reflector) 107 is disposed inside the main body casing (A) 101 such that the distance between the parasitic element 107 and the grounded outer conductor 715 serving as an antenna becomes a quarter of the wave length, for example, 31 mm.

Operation of the antenna of the behind-the-ear wireless device 100 is now described. As mentioned previously, the grounded outer conductor 715 is configured to operate as an antenna and has a length of about half wave length. The distance between the grounded outer conductor 715 and the parasitic element (the reflector) 107 is about a quarter of the wave length. Hence, the parasitic element (the reflector) 107 operates as a reflector, and the directivity of the antenna can be oriented in the user's line of sight 2.

As mentioned above, according to the fifth embodiment, the grounded outer conductor 715 is caused to operate as an antenna in the earphone cable 714. Accordingly, it is not necessary to additionally provide a component dedicated for an antenna element. Therefore, the number of components and cost can be reduced. Moreover, the parasitic element (the reflector) 107 having a lengths of a half wave length or more is placed in the main body casing (A) 101 such that the distance between the parasitic element 107 and the grounded outer conductor 715 having a length of about half wave length becomes about a quarter of the wave length. As a result, the parasitic element (the reflector) 107 operates as a reflector, and the directivity of the antenna can be oriented in the direction of the user's line of sight 2, so that the performance of communication with a TV set, or the like, positioned on the line of sight can be enhanced.

The parasitic element (the reflector) 107 may have a meandering shape as described in the first embodiment.

Similar antenna performance can also be achieved even when a conductor piece as the parasitic element (reflector) 107 is placed on the outer surface of the main body casing (A) 101, as described in the first embodiment.

Similar antenna performance can also be achieved even when the parasitic element (reflector) 107 is a conductive paint coating having a predetermined shape, as described in the first embodiment.

Sixth Embodiment

Figure 8:
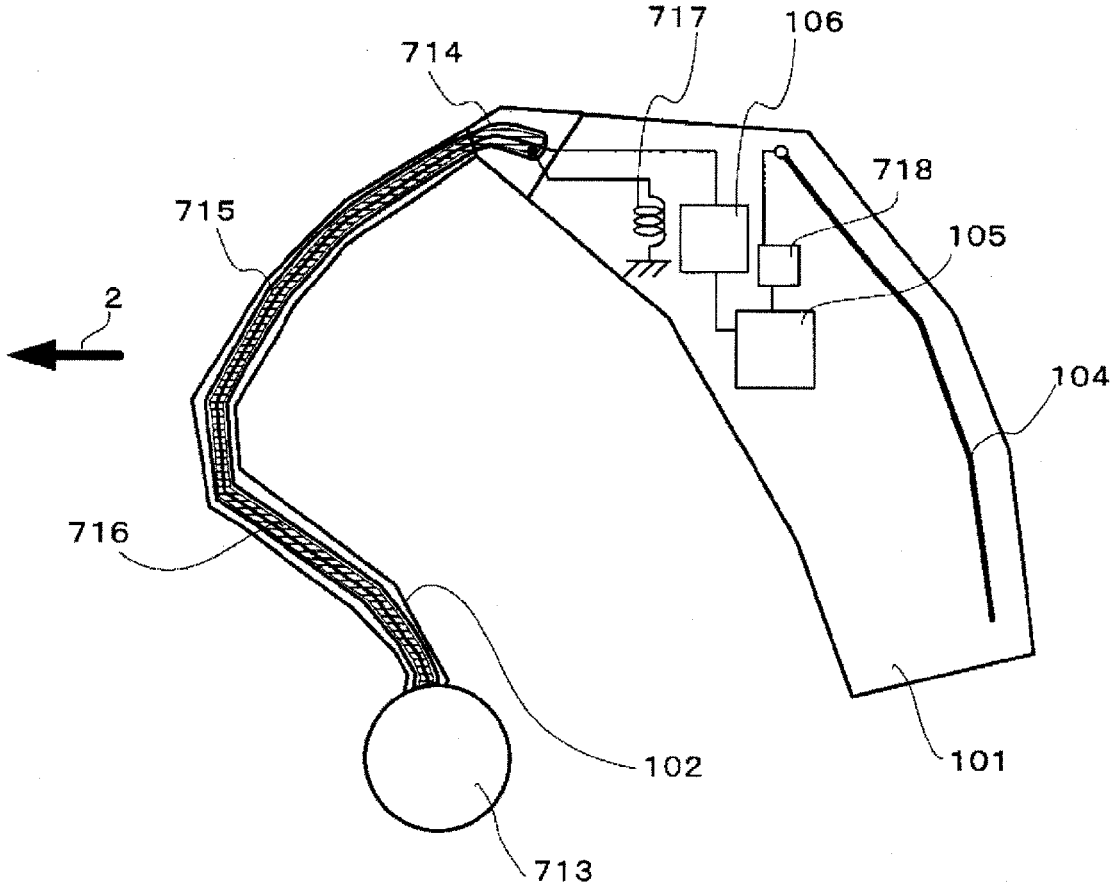
FIG. 8 is a schematic diagram of an antenna serving as both an earphone cable and a parasitic element (a radiator) of a behind-the-ear wireless device of a sixth embodiment of the present invention.

FIG. 8 shows a schematic diagram of an antenna serving as both an earphone cable and a parasitic element (a radiator) of a behind-the-ear wireless device of a sixth embodiment of the present invention. Elements identical with those shown in FIGS. 1, 2, 3, and 7 are assigned the same reference numerals, and their repeated explanations are omitted.

In FIG. 8, the grounded outer conductor 715 has length of about half wave length, for example, about 61 mm. One end of the grounded outer conductor 715, which is not connected to the earphone 713, is connected to the ground in the main body casing (A) 101 by way of the coil 717, i.e., the ground potential. However, the one end is not connected to the matching circuit 718. The antenna element 104 is disposed inside the main body casing (A) 101 such that the distance between the antenna element 104 and the grounded outer conductor 715 becomes about a quarter of the wave length, for example, 31 mm.

Operation of the antenna of the behind-the-ear wireless device 100 is now described. As mentioned above, the length of the grounded outer conductor 715 is less than the half wave length. Further, the distance between the grounded outer conductor 715 and the antenna element 104 is about a quarter of the wave length. Consequently, the grounded outer conductor 715 operates as a radiator, and the directivity of the antenna can be oriented in the direction of the user's line of sight 2.

As mentioned above, according to the sixth embodiment, the antenna element 104 having a length of about half wave length is disposed in the main body casing (A) 101 such that the distance between the antenna element and the grounded outer conductor 715 having a length of less than the half wave length becomes about a quarter of the wave length. The grounded outer conductor 715 thereby operates as a wave director, and the directivity of the antenna can be oriented in the direction of the user's line of sight 2. Performance of communication with a TV set, or the like, placed in the line of sight can be enhanced. Further, the grounded outer conductor 715 is caused to operate as a radiator in the earphone cable 714. Consequently, it is not necessary to additionally provide a component dedicated for a parasitic element that operates as a radiator, so that the number of components and cost can be curtailed.

The antenna element 104 may have a meandering shape as described in the second embodiment.

Although the present invention has been described in detail and by reference to the specific embodiments, it is matter of course that various changes or modifications may be adopted without departing from the spirit and scope of the present invention.

The present patent application is based on Japanese Patent Application No. 2008-023607 filed on Feb. 4, 2008 in Japan, the entire subject matter of which is incorporated herein by reference.

INDUSTRIAL APPLICABILITY

A behind-the-ear wireless device of the present invention comprises a first main body casing including a wireless circuit housed therein and an audio transmission unit having a function of transmitting sound from the first main body casing to an earhole and can be fitted to an ear by a configuration in which the first main body casing and the audio transmission unit are integrally connected, wherein the device comprises an antenna element having a length of about half wave length and disposed in the audio transmission unit, and a parasitic element having a length of about half wave length or more and disposed in the first main body casing.

According to the configuration, the parasitic element operates as a reflector, and directivity of the antenna can be oriented in a direction of a user's line of sight in a state where the behind-the-ear wireless device is fitted to the ear. Consequently, it is possible to enhance performance of communication with a TV set, or the like, positioned on the line of sight.

The invention claimed is:

1. A behind-the-ear hearing aid comprising:

a first main body casing including a wireless circuit housed therein;

a parasitic element having a length of a half wave length or more, and an audio transmission unit having a function of transmitting sound from the first main body casing to an earhole, wherein said behind-the-ear hearing aid is configured to be fitted to an ear in which the first main body casing and the audio transmission unit are integrally connected, wherein an antenna element having a length of a half wave length is disposed in the audio transmission unit, and wherein in a state where a user wears the hearing aid, the parasitic element and the antenna element are disposed in an arrangement along a direction of a line of sight of the user.

2. The behind-the-ear hearing aid according to claim 1, wherein the parasitic element is disposed in the first main body casing.

3. The behind-the-ear hearing aid according to claim 1, wherein the parasitic element is disposed on an outer surface of the first main body casing.

4. A behind-the-ear hearing aid comprising:

a first main body casing including a wireless circuit housed therein; and an audio transmission unit having a function of transmitting sound from the first main body casing to an earhole, wherein said behind-the-ear hearing aid is configured to be fitted to an ear in which the first main body casing and the audio transmission unit are integrally connected, wherein an antenna element is disposed in the first main body casing, wherein a parasitic element is disposed in the audio transmission unit, wherein a length of the parasitic element is less than a half wave length, and wherein in a state where a user wears the hearing aid, the parasitic element and the antenna element are disposed in an arrangement along a direction of a line of sight of the user.

5. A behind-the-ear hearing aid comprising:

a first main body casing including a wireless circuit and a speaker which are housed therein; and a behind-the-ear hanger, wherein said behind-the-ear hearing aid is configured such that, in a state where the behind-the-ear hanger is fitted to an ear, the first main body casing contacts a surface of an ear capsule in which an earhole exists, so as to transmit sound from the speaker to the ear, wherein an antenna element having a length of a half wave length is disposed in the first main body casing, wherein a parasitic element having a length of a half wave length or more is disposed in the behind-the-ear hanger, and wherein in a state where a user wears the hearing aid, the parasitic element and the antenna element are disposed in an arrangement along a direction of a line of sight of the user.

6. A behind-the-ear hearing aid comprising:

a first main body casing including a wireless circuit and a speaker which are housed therein; and a behind-the-ear hanger, wherein said behind-the-ear hearing aid is configured such that, in a state where the behind-the-ear hanger is fitted to an ear, the first main body casing contacts a surface of an ear capsule in which an earhole exists, so as to transmit sound from the speaker to the ear, wherein an antenna element is disposed in the behind-the-ear hanger, wherein a parasitic element is disposed in the first main body casing, wherein a length of the parasitic element is less than a half wave length, and wherein in a state where a user wears the hearing aid, the parasitic element and the antenna element are disposed in an arrangement along a direction of a line of sight of the user.

7. The behind-the-ear hearing aid according to claim 1, comprising:

an earphone configured to be fitted into the earhole and having a function as an audio output device; and an earphone cable provided in the audio transmission unit and having a function of transmitting an audio signal from the first main body casing to the earphone, wherein the earphone cable serves as the antenna element.

8. The behind-the-ear hearing aid according to claim 1, comprising:

an earphone configured to be fitted into the earhole and having a function as an audio output device; and an earphone cable provided in the audio transmission unit and having a function of transmitting an audio signal from the first main body casing to the earphone.

9. The behind-the-ear hearing aid according to claim 4, comprising:

an earphone configured to be fitted into the earhole and having a function as an audio output device; and an earphone cable provided in the audio transmission unit and having a function of transmitting an audio signal from the first main body casing to the earphone, wherein the earphone cable serves as the parasitic element.

* * * * *